US009480994B2

(12) United States Patent
Shankar et al.

(10) Patent No.: US 9,480,994 B2
(45) Date of Patent: Nov. 1, 2016

(54) SUSTAINABLE SHOWER

(71) Applicant: Conopco, Inc., Englewood Cliffs, NJ (US)

(72) Inventors: Venkatesh Shankar, Bangalore (IN); Shailendra Pratap, Bangalore (IN); Nimish Harshadrai Shah, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 222 days.

(21) Appl. No.: 14/385,542

(22) PCT Filed: Mar. 5, 2013

(86) PCT No.: PCT/EP2013/054358
§ 371 (c)(1),
(2) Date: Sep. 16, 2014

(87) PCT Pub. No.: WO2013/139588
PCT Pub. Date: Sep. 26, 2013

(65) Prior Publication Data

US 2015/0060570 A1 Mar. 5, 2015

(30) Foreign Application Priority Data

Mar. 21, 2012 (IN) ..... 748/MUM/2012
May 23, 2012 (EP) ..... 12169017

(51) Int. Cl.
*B05B 7/08* (2006.01)
*B05B 1/20* (2006.01)
(Continued)

(52) U.S. Cl.
CPC ..... *B05B 7/08* (2013.01); *B05B 1/207* (2013.01); *E03C 1/084* (2013.01); *B05B 7/0892* (2013.01); *B05B 15/12* (2013.01)

(58) Field of Classification Search
CPC ..... B05B 7/07; B05B 1/207; E03C 1/084
USPC ..... 4/601
See application file for complete search history.

(56) References Cited

U.S. PATENT DOCUMENTS 336,642 A 2/1886 Harder
1,982,509 A 11/1934 Frank
(Continued)

FOREIGN PATENT DOCUMENTS

BE 497290 12/1950
DE 3633449 4/1987
(Continued)

OTHER PUBLICATIONS

IPRP2 in PCTEP2013054358, Mar. 5, 2013.
(Continued)

*Primary Examiner* — Tuan N Nguyen
(74) *Attorney, Agent, or Firm* — Greenberg Traurig, LLP

(57) ABSTRACT

Disclosed is a shower apparatus comprising: •a housing (1, 2, 3) for an object (4); and •a plurality of set of coplanar nozzles inside said housing, the nozzles allowing for a simultaneous spray of a pressurized gas and a liquid on said object. Each set of nozzles comprises a first nozzle (7*a*, 7*b*, 7*c*) for spraying for spraying said gas and adjacent thereto at least one further nozzle (6*a*, 6*b*, 6*c*, 8*a*, 8*b*, 8*c*) for spraying said liquid. The axis of the nozzle for spraying said gas is arranged at an acute angle with respect to the axis of the nozzle for spraying said liquid. The nozzles are configured to provide improved cleansing in a single shower while consuming less water.

15 Claims, 2 Drawing Sheets

(51) Int. Cl.
*E03C 1/084* (2006.01)
*B05B 15/12* (2006.01)

(56) References Cited

U.S. PATENT DOCUMENTS

| | | | |
|---|---|---|---|
| 2,336,402 | A | 12/1943 | Kaiser |
| 3,760,431 | A | 9/1973 | Schwibner |
| 3,965,494 | A | 6/1976 | Baker |
| 4,171,094 | A | 10/1979 | Halfen |
| 4,651,720 | A | 3/1987 | Baus |
| 4,964,399 | A | 10/1990 | Faimali |
| 5,065,942 | A | 11/1991 | Shannon |
| 5,161,266 | A | 11/1992 | Hildebrand |
| 5,418,985 | A | 5/1995 | Antoine |
| 5,911,520 | A | 6/1999 | Kenney |
| 6,047,416 | A | 4/2000 | Carrier |
| 7,168,108 | B2 | 1/2007 | Guerin et al. |
| 8,458,826 | B2 | 6/2013 | Mock et al. |
| 2002/0096186 | A1 | 7/2002 | Von Halem |
| 2002/0112738 | A1 | 8/2002 | Parker |
| 2003/0094509 | A1 | 5/2003 | Venuto, Sr. |
| 2003/0163867 | A1 | 9/2003 | Zhou |
| 2005/0086735 | A1 | 4/2005 | Lim |
| 2005/0086738 | A1 | 4/2005 | Gragtmans |
| 2005/0210576 | A1 | 9/2005 | Guerin |
| 2006/0064815 | A1 | 3/2006 | Guerin et al. |
| 2006/0275555 | A1 | 12/2006 | Colizza |
| 2007/0107121 | A1 | 5/2007 | Smith et al. |
| 2010/0242166 | A1 | 9/2010 | Chan |

FOREIGN PATENT DOCUMENTS

| | | |
|---|---|---|
| DE | 4140105 | 6/1993 |
| DE | 4204308 | 8/1993 |
| DE | 4325971 | 2/1995 |
| DE | 19528669 | 2/1997 |
| DE | 10012941 | 5/2001 |
| DE | 10306185 | 7/2006 |
| EA | EP1205606 | 3/2006 |
| EP | 0336845 | 10/1989 |
| EP | 1346912 | 9/2003 |
| EP | 2135536 | 12/2009 |
| EP | 2233649 | 9/2010 |
| FR | 2709940 | 3/1995 |
| FR | 2834196 | 7/2003 |
| FR | 2846551 | 5/2004 |
| GB | 380831 | 9/1932 |
| GB | 2126888 | 4/1984 |
| GB | 2146522 | 4/1985 |
| GB | 2243546 | 11/1991 |
| GB | 2266662 A | 11/1993 |
| GB | 2412582 | 10/2005 |
| GB | 2454228 | 5/2009 |
| WO | WO03082068 | 10/2003 |

OTHER PUBLICATIONS

IPRP2 in PCTEP2013073837, Dec. 19, 2014.
Search Report in EP12190932, Apr. 8, 2013.
Search Report in EP13150090, May 31, 2013.
Search Report in PCTEP2013071025, Jan. 17, 2014.
Search Report in PCTEP2013073837, Feb. 25, 2014.
Written Opinion in EP12190932, Apr. 8, 2013.
Written Opinion in EP13150090, May 31, 2013.
Written Opinion in PCTEP2013071025, Jan. 17, 2014.
Written Opinion in PCTEP2013073837, Feb. 25, 2014.
Search Report in EP12169017, Sep. 26, 2012.
Search Report in PCTEP2013054538, Aug. 26, 2013.
Written Opinion in EP12169017, Sep. 26, 2012.
Written Opinion in PCTEP2013054358, Aug. 26, 2013.

SUSTAINABLE SHOWER

FIELD OF THE INVENTION

The present invention relates to a shower apparatus for sustainable use of water by providing a quicker shower but with more cleansing.

BACKGROUND AND RELATED ART

Showers are very common in bathrooms around the world. Although, not so common, showers are also used for bathing animals; generally pets. They are also used to clean inanimate objects like cars. Showers supply constant flow of slightly pressurised water for a perceivable degree of cleansing, particularly when aided with a cleansing agent. However, constant flow of water leads to higher usage. Given the scarcity of water across the globe and the predictions of several eminent environmentalists about water-scarce regions of the future, it is necessary to act now for sustainable use of water.

It is known to combine air and water in a shower head as disclosed in U.S. Pat. No. 5,065,942 B1 (Shanon, 1991). This patent describes a shower cubicle where a jet of water is used to create a massage effect. Although variable speed has been disclosed, the consumption of water is not. Further, the extent of cleaning has not been disclosed.

Realising the importance of conservation of water, some attempts were made in the past to reduce its usage.

U.S. Pat. No. 7,168,108 B2 (The Boeing Company, 2007) discloses a showering system on-board an aircraft, where a controller directs misted air through a misting nozzle and further activates an air flow system such that misted air within the shower area flows through and is dried.

The technique minimizes water usage and requires a minimal amount of space onboard. In this case also, the efficiency of cleaning has not been disclosed.

US2002112738 A1 (PARKER et. al) discloses an apparatus for the coating of a human body with a tanning composition, such as a sunless tanning composition. An arm with a plurality of nozzles traverses within a booth to spray the coat on a body inside the booth. The spray nozzles are oriented to avoid opposing air flows and excessive air flows which cause inefficient and uneven, dripping or streaking in the deposition of tanning composition on the skin.

A single shower may not remove 100% soil, especially sebaceous soil. However, cleaning to the extent of about 40% is generally considered good. Known quick showers do not always provide this level of cleansing, especially if soap or any other cleanser is not used.

Accordingly, a desired shower apparatus is the one which consumes lesser water, provides a quicker shower and more cleansing. Quick-showers are useful when a large number of individuals are expected to share common facilities for bathing as in such cases, time is generally a constraint. In community bathing facilities, hygiene also becomes an important aspect.

An object of the present invention is to provide a shower apparatus that solves some or all problems of prior art.

We have developed a shower apparatus having plurality of nozzles to simultaneously spray a pressurised gas and a liquid on an object, which can be located at a reasonable distance from the nozzles. The nozzles are configured to provide cleansing in a single shower, while consuming lesser water. The nozzles are also movable in relation to the object to be cleaned, thereby allowing for adequate coverage and cleansing at the same time.

SUMMARY OF THE INVENTION

Disclosed is a shower apparatus having:

(i) a housing for an object (4); and (ii) a plurality of sets of coplanar nozzles inside the housing for a simultaneous spray of a pressurised gas and a liquid on the object;

wherein each set has:

(i) a nozzle for spraying the gas; and (ii) adjacent thereto, at least one nozzle for spraying the liquid, and wherein the tip of the nozzle for spraying the gas is at an acute angle with the tip of each nozzle for spraying the liquid.

A preferred apparatus, wherein each set has three nozzles:

(i) a middle nozzle for spraying the gas; and, (ii) two nozzles adjacent thereto, one each on either side thereof, for spraying the liquid, wherein the tip of the middle nozzle is at an acute angle with the tip of each of said two nozzles in (ii).

In a preferred embodiment, in each set of nozzles, the tip of the nozzle for spraying the gas terminates a distance of upto 0.4 cm before or upto 1 cm ahead of the tips of each nozzle for spraying the liquid.

In a further preferred embodiment, the distance between the plurality of set of coplanar nozzles and the object is 3 inches to 18 inches.

In a yet further preferred embodiment the acute angle is 20° to 60°.

Additional advantages and features of the present invention will become apparent from the description that follows in conjunction with the accompanying drawings.

DETAILED DESCRIPTION

The concept of sustainable sourcing and sustainable use of natural resources is gaining widespread momentum. Several companies have started including elements of sustainability in their corporate agenda and vision. Some companies also publish sustainability reports.

Water is one of the most important natural resources. It is known that a very small proportion of available water is fit for potable and non-potable use.

In a day, several hundred thousand liters of water gets consumed in showers around the world. Quick showers were invented in order to reduce it. Some of the quick showers spray a mist of air and water instead of water alone. These are often found in aircrafts, gyms, youth hostels and airline lounges. However, as described earlier, in the limited amount of time that a user spends in such quick showers, coupled with the fact that the amount of water for each shower is generally fixed by pre-programmed controls; such quick showers are generally not able to remove oily soil to the extent one desires. Therefore, users generally not feel fully cleansed and refreshed after a shower. Further, as described earlier, in such community bathing facilities, hygiene becomes an important factor.

Disclosed is a shower apparatus having:

(i) a housing for an object; and (ii) plurality of set of coplanar nozzles inside the housing for a simultaneous spray of a pressurised gas and a liquid on the object;

wherein each set has:

(i) a nozzle for spraying the gas; and (ii) adjacent thereto, at least one nozzle for spraying the liquid, and wherein tip of the nozzle for spraying the gas is at an acute angle with tip of each nozzle for spraying the liquid.

In a preferred apparatus, each set has three nozzles:

(i) a middle nozzle for spraying the gas; and, (ii) two nozzles adjacent thereto, one each on either side thereof, for spraying the liquid, wherein tip of the middle nozzle is at an acute angle with the tip of each of the two nozzles in (ii).

Co-planarity allows liquid and gas to be sprayed effectively and uniformly and allows the mist to be directed properly towards the object.

As described earlier, the tip of the nozzle for spraying the gas is at an acute angle with tip of each nozzle for spraying the liquid. In preferred embodiments, this acute angle is 20° to 60°. Preferred angles enable better cleansing and targeted delivery of the mist of the gas and the liquid, particularly when it is water. Angles lower than 20° are less preferred because the spray pattern and reach of the spray is adversely affected. In further preferred embodiments this acute angle is 40° to 50°. The optimal acute angle is 45°. In the case of angles greater than 60° the coverage is more but impact of the mist is lower. This affects the cleansing. At the same time, angles lower than 20° cause a greater impact, which is inconvenient to some persons. Further, the coverage is lower.

All nozzles have an internal diameter which allows the liquid to flow through them. It is preferred that the internal diameter of each nozzle is from 0.5 mm to 0.8 mm, more preferably from 0.6 mm to 0.7 mm. This provides proper balance between pressure, reach, coverage and cleansing efficacy. When the internal diameter is below 0.5 mm, the shower experience is not pleasurable because improper mist formation. On the other hand, diameters above 0.8 mm will lead to increased water consumption and create oversized droplets which are difficult to be conveyed by the gas at manageable pressure.

Internal diameter of the nozzles is also important from the point-of-view of safety as well as from the efficacy of cleaning. In the case of normal showers, a question of safety does not arise because the size of droplets is well within the prescribed limits of safety. However, in the case of gas-assisted showers, uncontrolled sizes can be harmful. Droplet sizes lower than 8 μm can adversely affect the respiratory system because finer droplets can enter the lungs. On the other hand, larger droplets do not pose such safety related problems but can adversely affect the sensorial perception and reduce the pleasure of showering. Oversized droplets have lower surface area. Therefore, efficacy of cleansing is also on the lower side.

In a highly preferred embodiment, in each set of nozzles, the tip of the nozzle for spraying the gas and the tips of the nozzles for spraying the liquid are not offset, i.e. there is no distance between them. However, it is equally preferred that the tip of the nozzle for spraying the gas terminates a distance of upto 0.4 cm before or upto 1 cm ahead of the tips of each nozzle for spraying the liquid. Outside the preferred range, there is inadequate contact of the gas with the liquid which affects the spray pattern. In such cases, although a mist is created, it fails to cover an appreciable distance, i.e. the reach. In such cases it is essential to keep the object very close to the nozzles. Such an arrangement will not be considered to be comfortable by users when several individuals use common shower facilities.

A preferred shower apparatus has from ten to hundred sets of the nozzles. The nozzle can be located on any suitable substrate inside the housing. It is preferred that the nozzles are located on plurality of pipes forming a ring which surrounds the object.

Preferably, the plurality of pipes is in the form of at least one group of three pipes, each group having a first pipe having said nozzles thereon to spray the pressurized gas and two pipes, one each on either sides thereof having the nozzles thereon to spray the liquid.

For optimum cleaning and uniform wetting, it is preferred that wherever there are multiple groups, the groups are equally spaced apart. Each pipe can have preferably from ten to hundred nozzles depending on the size of the ring. It is preferred that there are ten to fifty nozzles and more preferably ten to thirty nozzles on each pipe. Nozzles can be appropriately configured or placed on the pipe. In each set of pipes, it is preferred to have the pipes equidistant from each other, but a non equidistant configuration can also be used.

In a preferred embodiment, the sets of nozzles are movable in one or more directions relative to the object. This provides better coverage and cleaning. It is further preferred that all the sets of nozzles are movable in the same direction relative to the object. Movement can be along the length of the object or along any dimension of the object. It can also be in a spiral manner. The manner in which it moves is not as important as movement itself. The movement can help in quickly sweeping the entire body of the object. The number of times this movement occurs can be pre-decided and with appropriate mechanisms in place, such as electronic controls, this can be pre-programmed. Thus there can be one or two or more cycles of sweep across any dimension of the object. In the case of human beings, it is preferably along the height of the person using the shower.

Thus there can be a first wetting cycle where the nozzles sweep across the user's height spraying a mist of air and water, for example, from his feet to the head to wet the body; a second cycle in which the nozzles sweep the body downwards, this time spraying a mist of air and water, for example, containing a cleansing composition. In a third cycle, which can begin immediately thereafter, the nozzles spray a mist of air and water across the height of the user. There preferably is a final drying cycle in which hot or cold gas, preferably air, is sprayed. This feature can further enhance comfort, convenience and the sustainability factor, as towels need not be necessarily used.

For the purpose of safety, the ring is provided with motion sensors to stop the movement if the user inadvertently touches the ring if it is considered unsafe for further continuance of the movement.

The features are especially relevant in the context of community shower facilities where time, water and availability of shower facilities are limited. It is preferred that the shower apparatus has a frame to support the plurality of pipes. The frame is a structure that provides concrete dimensions to the shower apparatus. In a preferred embodiment, as described earlier, the pipes completely surround the object to form a ring. The shape of the ring may be square, rectangular, hexagonal or any other regular or irregular shape. When circular, the diameter of the ring is preferably 1 to 1.5 meters. In the case of other shapes, equivalent dimensions can be used. This helps to provide optimal pressure for superior cleaning and the ring provides 360° cleaning without the person necessarily having to move or turn around inside the housing.

The frame has plurality of tracks thereon wherein the plurality of pipes is movable on the tracks. In order to ensure smooth and efficient movement of pipes, the pipes are operatively connected by plurality of connectors to wheels rotatably mounted on tracks along the length of the frame. Any suitable movement mechanism can be employed. Preferred methods include manual, hydraulic, pneumatic, electromechanical or magnetic means. For this reason, preferably a motor is used.

Wherever the controls and moving parts are electrically driven, the disclosed shower apparatus also consumes lesser power than conventional quick showers. A half Horse Power motor is generally suitable for causing motion of the moving parts.

This will keep the total operational power consumption to 2.5 to 4 kWh. The power consumption for operating the compressor for the gas is 4 to 6 kWh for about eight hours of continuous usage. In this manner, the total power consumption is 6.5 to 10 kWh. Lower power consumption further enhances the sustainability factor of the shower apparatus.

The gas used in the shower apparatus is pressurised. A compressor is used for this purpose. Air is the most preferred gas and equivalents include Oxygen. Any other suitable gas may be used subject to safety compliance for the intended application. In order to aid cleaning, the operating pressure of the gas is preferably maintained from 2 bar to 8 bar, more preferably 4 bar to 8 bar.

Water is the most common and the most preferred liquid. Other suitable liquids, like solvents, can be used, keeping in mind the safety concerns. Solvents can be used to clean inanimate objects like cars. If desired, the water can be pressurised, but this is not essential as the flow through the nozzles will itself result in some pressure which is generally adequate. If required, the liquid can also contain small amount of a cleansing composition, such as a shower gel.

When water turns into a mist, it cools rapidly, especially if the mist traverses a distance of over ten inches. This cooling effect can be used for a refreshingly cool bathing experience in hot or warm climates. It is preferred that the temperature of the liquid, particularly water is from 10° C. to 60° C. On the other hand, where people prefer hot or warm showers, the in-use temperature needs to be higher. In such cases, it is preferred that in-use temperature of the liquid, particularly water is maintained in the range of 40° C. to 60° C. by heating the water with appropriate means. In addition to the water or the liquid, as the case is; the gas can also be heated suitably. Gases can be heated quickly using lesser energy.

In order to have ample availability of the liquid whenever necessary, the shower apparatus also has a storage compartment. This can be in the form of an overhead tank. Alternatively, there is a running supply of the liquid, as is common in the case of water.

It is preferred that flow rate of the liquid, particularly water, is maintained in the range of 100 to 300 ml/minute. In preferred embodiments, the rate is 100 to 250 ml/minute.

The distance between the object to be cleaned and the nozzles can also play an important role in cleansing. Therefore, it is preferred that the distance between the plurality of set of coplanar nozzles and the object is 3 inches to 18 inches (7.62 to 45.72 cm) for good cleansing. Cleaning is further enhanced at a distance of 15 to 18 inches (38.1 to 45.72 cm). When the ring is beyond 20 inches (50.8 cm), the impact of the mist is lower. It was observed that a distance of 9 to 11 inches (22.86 to 27.94 cm) provides 50% cleansing when the shower time was one minute. At 18 inches and shower time of two minutes, the 60% cleansing was observed. However, if the nozzles are placed too close to the object, the impact of the mist is too high for comfort and the overall cleansing is also adversely affected. Comfort is an essential factor for human beings. Further, in a community context, in view of personal hygiene, the distance also becomes an important factor.

Preferred embodiments of the shower apparatus consume 1 liter to 4 liters liquid, particularly water, for one-time use, more preferably 1 to 2 liters water. The shower apparatus provides a single complete shower experience with significantly limited amount of water as compared to conventional showers and known quick showers, or even a bucket bath which is practiced in many parts of the world. A typical quick conventional shower uses anywhere from 10 to 15 liters of water, whereas typical bucket bath needs about 20 liters water.

Known quick showers can provide upto 10 showers per hour. A preferred shower apparatus provides one shower in one to two minutes. The disclosed shower apparatus provides one complete shower experience typically in about 2 minutes, including, as described earlier with appropriate program controls, a drying cycle. Therefore the disclosed apparatus is capable of providing about 25 to 30 showers per hour.

While the shower apparatus can be made without a platform or a cover, it is preferred that the housing has a roof and a platform for a comfortable enclosure for the user or the object. The platform is useful for positioning the object when the shower is in use.

Further, the platform has a raised pedestal for placing the object, or on which a human being can stand. This will provide additional comfort and is useful for shorter individuals. The apparatus is preferably enclosed by a covering made of any suitable material such as glass, plastic, wood, ceramic, stainless steel, or shower drapes or curtains. Other equivalent materials include hard plastics, polymers, fibre glass or Teflon®. The frame, roof, platform, pipes and the nozzles are preferably made of stainless steel but any other material of construction can be used.

In order to drain away the used water, it is preferred that the shower apparatus includes an outlet. This is preferably placed on or near the platform. Used water can be recycled to improve the sustainability factor. In order to increase the sustainability factor, the shower apparatus has a means for post-use treatment to enable reuse or recycle. For this purpose, the shower apparatus has, at the base of the apparatus, or any convenient location, a provision for collection of waste water. An appropriate provision can be made for transferring this water to a suitable storage or treatment plant to treat the water to make it fit for other applications (e.g. gardening/agriculture).

Known devices and compositions which are fit for this purpose can be used. Such device(s) can be suitably placed outside or inside the apparatus.

In order to make the shower apparatus comfortable for human beings, it is preferred that an exhaust fan is included in the housing. It can be located at any suitable position, such as near the roof.

After completion of one shower, the cubicle is preferably sanitized by any known means, such as fumigation, to make it suitable, hygienic and ready-to-use for the next user. Appropriate electronically controlled timed-release means can be used for this purpose. Such means (dispensers) are commonly found in washrooms at airports, where the devices spray a perfume at pre-determined timed intervals.

In order to control the motion of various parts and the overall functioning of various features of the apparatus, a control panel is preferably used. Such a panel can either be located inside or outside the housing. This control panel is equipped to control multiple functions such as the movement of the pipes or nozzles, the speed, the time of movement, the pressure of the gas, flow-rate of the liquid, dispensing of specific materials (cleansing formulation, fragrance), the exhaust mechanism, temperature of water, recycling of used water and disinfection or sanitisation of the housing.

The shower apparatus is primarily meant for the purpose of community bathing and disclosed preferred embodiments are designed for this purpose. Accordingly, the shower apparatus is primarily meant for human beings, but with appropriate modifications, it can be made fit for use for pets or other animals or any other inanimate object, such as a car. The dimensions of the shower apparatus can be designed according to the purpose for which it is being used.

BRIEF DESCRIPTION OF THE FIGURES

For better understanding, the invention will now be described by way of non-limiting embodiments of shower apparatus, reference being made to the accompanying drawings in which.

DETAILED DESCRIPTION OF FIGURES

In all the figures, like numerals indicate like features.

Figure 1:
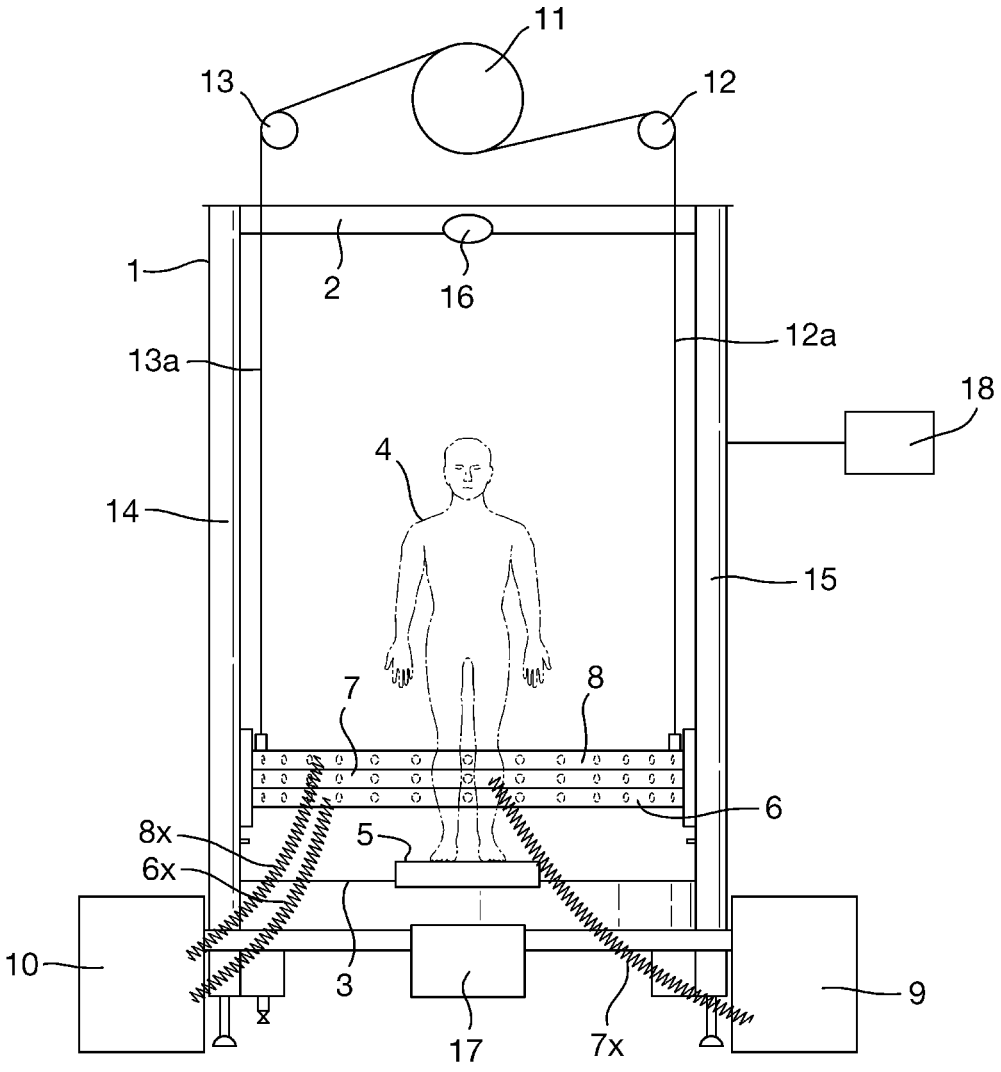
FIG. 1 is a front (plan) view of a first preferred embodiment of the shower apparatus.

Referring now to FIG. 1, the shower apparatus consists of a frame (1) having a roof (2) and a platform (3) which taken together defines a housing for the object (4). A raised pedestal (5) is also provided for the object (4) to stand. One movable group of three pipes (6, 7, 8) facing the object (4) is placed transversely on the frame. The group has a middle pipe (7) with nozzles thereon to spray a gas and two adjacent pipes, one on either side thereof, each having nozzles thereon to spray a liquid. The pipes surround the object within the enclosure by forming a circular ring around the object (4). The middle pipe (7) is in fluid communication with a compressor for pressured air (9) through a connector pipe (7*x*). Each outer pipe (6 and 8) is individually connected by connector pipes (6*x*) and (8*x*) to a water tank (10).

Near the roof (2) is a motor (11) controlling a pair of pulleys (12) and (13), which in turn support a pair of steel ropes (12*a*) and (13*a*). With the help of this motor-pulley-rope system, the group of three pipes (6, 7, 8) is movable upwards and downwards along the length (height) of the apparatus. With the help of the movable group of pipes the whole body of the object (4) can be sprayed with a mist of air and water.

The group of pipes is operatively connected by plurality of connectors (not seen in this view) to wheels (not seen) which are rotatably mounted on corresponding tracks (14 and 15) along the length (height) of the cubicle. The roof also has an exhaust fan (16) to remove humid and warm air from the housing.

The cubicle also has a drain (not shown), which in turn is connected to a recycler (17) for treatment of waste-water to make it fit for secondary use.

An externally located control panel (18) controls the operation of the shower apparatus.

Figure 2:
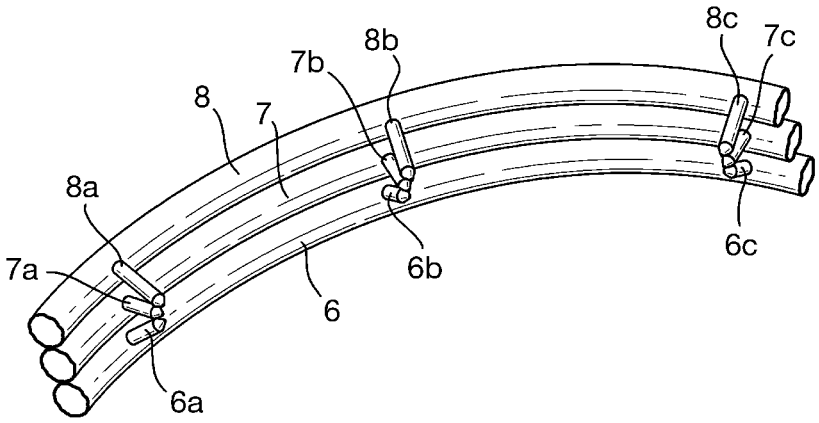
FIG. 2 is an isometric view of a portion of the pipes shown in FIG. 1, showing the arrangement and configuration of nozzles thereon.

Referring now to FIG. 2, which is an isometric view of a portion of the pipes (6, 7 and 8) of FIG. 1 showing the arrangement and configuration of the multiple sets of three-nozzles, it can be seen that the nozzles (7*a*, 7*b*, 7*c*) on the middle pipe (7) are perpendicular to the pipe (7). The tip of the nozzle (7*a*) for spraying the gas is at an acute angle with tip of each nozzle (6*a* and 8*a*) for spraying the liquid. Similarly, the tip of the nozzle (7*b*) for spraying the gas is at an acute angle with tip of each nozzle (6*b* and 8*b*) for spraying the liquid.

Figure 3:
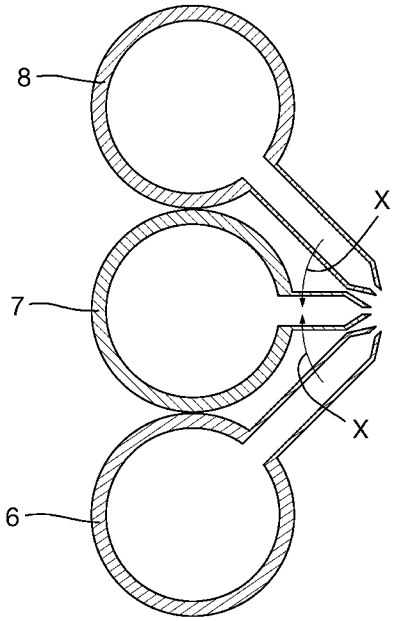
FIG. 3 is cross sectional view of the pipes of FIG. 1 through one set of three nozzles, showing the angles formed at the tips of the nozzles.

FIG. 3 is cross sectional view of the pipes of FIG. 1 through one set of three nozzles, showing the angles formed at the tips of the nozzles. The angles (X) formed by the tip of the nozzle on pipe (7) with the tips of nozzles on pipes (6) and (8) is 45°.

Any user desirous of using the apparatus enters the housing and stands on the pedestal. If it is an inanimate object, it is placed over the pedestal. At this time, the ring can be above the head of the user or it may be suitably positioned near the feet. The user then switches the system on through the control panel and enters his preference for the controls. As the system is switched on, the ring gradually ascends or descends (depending on its initial position and the program) and at the same time, the nozzles start spraying air and water, which eventually becomes a mist to be sprayed on the user. A single cycle of upward or downward motion can be pre-programmed to be completed in one minute or lesser or more time. Similarly, the entire showering process can be pre-programmed to be completed after the ring moves up and down once, or multiple times. If desired by the user, hot air is blown through the nozzles as the ring travels upwards or downwards during the last cycle. This feature is useful for a towel-free drying. The exhaust fan placed suitably close to the roof helps pull out hot and humid air from the housing, thereby providing comfort.

The invention will now be further illustrated by means of the following non limiting examples.

EXAMPLES

Example 1

Cleansing as a Function of Distance and Temperature

An adult human-size mannequin was procured and covered completely with artificial skin made of Replica Silflo® resin (supplier Cuderm). The mannequin was smeared with edible oil (to simulate sebum and sebaceous soil) and was placed on the pedestal of the apparatus of FIG. 1. The distance of the ring from the mannequin was varied to find out whether it had any effect on the extent of cleansing. In this experiment, the temperature of water was maintained at 50° C. and no cleansing agent was added to it.

The mist was sprayed for one minute, during which time; the ring was made to ascend from the feet to the head of the mannequin. Only one liter water was consumed. The internal diameter of all the nozzles was 0.7 mm and the pressure of air was maintained at 4 bar. Flow-rate of water was maintained at 100 ml/minute.

In the next set of experiments, the procedure was repeated by maintaining the temperature of water at 25° C., all other parameters remaining unchanged.

In a further experiment, temperature of water was maintained at 25° C. but it was sprayed for 2 minutes using 2 liters of water cumulatively for one cycle of ascent and one of descent of the ring.

The data is shown in table-1.

TABLE 1

| Distance between ring and object (inches) | % cleansing 50° C. 1 minute | % cleansing 25° C. 1 minute | % cleansing 25° C. 2 minutes |
|---|---|---|---|
| 2 | 100 | 99 | 99 |
| 4 | 99 | 97 | 98 |
| 6 | 99 | 94 | 96 |
| 8 | 78 | 87 | 95 |
| 10 | 74 | 56 | 92 |
| 12 | 47 | — | 82 |
| 15 | 45 | — | 69 |
| 18 | 40 | — | 60 |

The data in column 1 indicates decrease in cleansing with an increase in the distance. However, even at a distance of 18 inches (45.72 cm), cleansing was still as high as 40%. The data in column 2 indicates 56% cleansing from a distance of 10 inches (25.4 cm) as against 74% cleansing achieved with heated water from the same distance.

This establishes the preference for use of heated water for more cleansing. The data in column number 3 indicates significantly higher level of cleansing even at a distance of 18 inches (45.72 cm). At 10 inches (25.4 cm), the cleansing was 92% as against 56% for one minute in column 2. Thus, a 2-minute shower time is preferred over 1-minute shower time, but it means more consumption of water.

Example-2

Effect of Varying Nozzle Angles and Varying Nozzle Lengths on the Mist and Reach A series of sets of three coplanar stainless steel nozzles was fabricated on three stainless steel pipes. As described earlier, in each set, all nozzles in the middles were connected to compressed air and the other two nozzles in each set were connected to source of plain water. In the first round of experiments, the angles between the nozzles, as described earlier, was varied. The length of all the nozzles was kept same and tips of all nozzles in each set coincided.

In the second series of experiments, the angle was kept constant between all the sets but the distance between the tip of the nozzle in the middle and that of the two nozzles adjacent thereto was varied, i.e. the tip of middle nozzle was behind or ahead of the tips of the two nozzles in each set.

For both the experiments, pressure of air was maintained at 4 bar and the flow-rate of water was maintained at 100 ml/minute. The target object as in example-1 was kept at fixed distance of 18 inches.

The data is shown in tables 2 and 3.

TABLE 2

| Angle | Observation | Inference |
|---|---|---|
| all nozzles in each set were parallel to each other | mist not formed | not useful |
| 10° | poor mist | not preferred |
| 20° | good mist | preferred |
| 30° | good mist | preferred |
| 40° | very good mist | more preferred |
| 45° | optimal mist | most preferred |
| 50° | very good mist | more preferred |
| 60° | good mist | more preferred |
| 70° | fairly good mist | less preferred |

TABLE 3

| Distance | Reach/inches | Inference |
|---|---|---|
| 0.4 cm behind | 18 (45.72 cm) | highly preferred |
| 0.5 cm behind | 8 (20.32 cm) | less fit for use |
| 1 cm ahead | 18 (45.72 cm) | highly preferred |

The data in table 2 shows the preference for angles in the range of 20° to 60°. The data in table 3 indicates that distance more than 0.4 cm is not preferred.

Example-3

Effect on Droplet Size

The objective of this set of experiments was to find out the effect of varying pressure of air, varying nozzle diameters and varying flow-rate of water on the droplet size. The droplet sizes were measured at varied distances. This set of experiments was conducted without any target object to be cleaned. The angles between nozzles were kept constant at 45°.

TABLE 4

| Diameter: 0.5 mm Pressure: 5 Bar Flow rate: 100 ml/minute | D10# | Diameter: 0.7 mm Pressure: 5 Bar Flow rate: 100 ml/min | D10# |
|---|---|---|---|
| at 18 inches | 20 | at 18 inches | 22 |
| at 15 inches | 42 | at 15 inches | 25 |
| at 12 inches | 358 | at 12 inches | 28 |
| — | | at 10 inches | 36 |
| — | | at 6 inches | 24 |

Note:
In this table, and all tables that follow, D10# represents the statistically significant size of 90% of the droplets formed in μm.

Data for experiments conducted at nozzle diameter 0.5 mm; pressure of air varied from 4 bar to 7 bar and flow-rate of water 100 ml/minute is shown in table-5.

TABLE 5

| Pressure of air | D10 at 18 inches (45.72 cm) | D10 at 12 inches (30.48 cm) | D10 at 6 inches (15.24 cm) |
|---|---|---|---|
| 4 Bar | 20 | 26 | 23 |
| 5 Bar | 20 | 42 | 358 |
| 6 Bar | 21 | 39 | 17 |
| 7 Bar | 22 | 39 | 343 |

Data for experiments conducted at nozzle diameter 0.7 mm; pressure of air varied from 4 bar to 7 bar and flow-rate of water 100 ml/minute is shown in table-6.

TABLE 6

| Pressure of air | D10 at 18 inches (45.72 cm) | D10 at 12 inches (30.48 cm) | D10 at 6 inches (15.24 cm) |
|---|---|---|---|
| 4 Bar | 21 | 24 | 32 |
| 5 Bar | 22 | 28 | 24 |
| 6 Bar | 20 | 26 | 32 |
| 7 Bar | 39 | 64 | 22 |

Data for experiments conducted at diameter 0.7 mm; pressure of air 5 bar and flow-rate of water varied from 100 to 250 ml/minute is shown in table-7.

TABLE 7

| Flow rate | D10 at 18 inches (45.72 cm) | D10 at 12 inches (30.48 cm) | D10 at 6 inches (15.24 cm) |
|---|---|---|---|
| 100 | 24 | 233 | 112 |
| 150 | 22 | 324 | 91 |
| 200 | 21 | 44 | 34 |
| 250 | 22 | 29 | 25 |

Data for experiments conducted at diameter 0.5 mm; pressure of air 5 bar and flow-rate of water varied from 100 to 250 ml/minute is shown in table-8.

TABLE 8

| Flow rate | D10 at 18 inches (45.72 cm) | D10 at 12 inches (30.48 cm) | D10 at 6 inches (15.24 cm) |
|---|---|---|---|
| 250 | 28 | 64 | 190 |
| 200 | 28 | 134 | 380 |
| 150 | 24 | 62 | 417 |
| 100 | 20 | 42 | 258 |

The data in all the tables 4 to 8 indicates that inspite of all the changes, the droplet size remained well above the safe limit of 8 μm. This data was statistically significant.

The illustrated examples describe a shower apparatus that provides more cleansing of sebaceous soil, using lesser water and time. The disclosed shower apparatus provides more cleansing while still meeting the objective of sustainability and time. It will be useful in places and occasions where people gather in large numbers and where they want to freshen-up quickly. Such places and occasions include religious and social gatherings, transportation lounges, stations, terminals, aircrafts, ships and trains.

Although the best mode of the present invention has been described for illustrative purposes, those skilled in the art will appreciate that various modifications, additions and substitutions are possible, without departing from the invention as disclosed in the specification.

The invention claimed is:

1. A shower apparatus comprising a housing for an object (4), characterised in that the apparatus also comprises a plurality of sets of coplanar nozzles inside said housing, for a simultaneous spray of a pressurized gas and a liquid on said object;

wherein each set comprises:

(i) a nozzle (7*a*, 7*b*, 7*c*) for spraying said gas; and (ii) adjacent thereto, at least one nozzle (6*a*, 6*b*, 6*c*) for spraying said liquid, and wherein the tip of said nozzle (7*a*, 7*b*, 7*c*) for spraying said gas is at an acute angle (X) with the tip of each nozzle (6*a*, 6*b*, 6*c*) for spraying said liquid.

2. A shower apparatus as claimed in claim 1 wherein each said set comprises three nozzles:

(i) a middle nozzle (7*a*, 7*b*, 7*c*) for spraying said gas; and, (ii) two nozzles (6*a*, 6*b*, 6*c*, 8*a*, 8*b*, 8*c*) adjacent thereto, one each on either side thereof, for spraying said liquid, wherein the tip of each of said middle nozzle (7*a*, 7*b*, 7*c*) is at an acute angle (X) with the tip of each of said two nozzles (6*a*, 6*b*, 6*c*, 8*a*, 8*b*, 8*c*).

3. A shower apparatus as claimed in claim 1 wherein the tip of said nozzle for spraying said gas terminates a distance of upto 0.4 cm before or upto 1 cm ahead of tip of each nozzle for spraying said liquid.

4. A shower apparatus as claimed in claim 1 wherein the distance between said plurality of sets of coplanar nozzles and said object is 7.62 cm to 45.72 cm or 3 inches to 18 inches.

5. A shower apparatus as claimed in claim 1 wherein operating pressure of said gas is 2 bar to 8 bar.

6. A shower apparatus as claimed in claim 1 wherein said acute angle is 20° to 60°.

7. A shower apparatus as claimed in claim 1 wherein internal diameter of each said nozzle is 0.5 mm to 0.8 mm.

8. A shower apparatus as claimed in claim 1 wherein said plurality of set of nozzles is movable in one or more directions relative to said object.

9. A shower apparatus as claimed in claim 1, comprising ten to hundred set of nozzles.

10. A shower apparatus as claimed in claim 1 comprising plurality of pipes forming a ring around said object wherein said nozzles are located on said pipes.

11. A shower apparatus as claimed in claim 10 wherein each said pipe comprises ten to hundred nozzles.

12. A shower apparatus as claimed in claim 10 comprising at least one group of three pipes comprising a middle pipe having nozzles thereon to spray said gas and two adjacent pipes, one on either side thereof, each having nozzles thereon to spray said liquid.

13. A shower apparatus as claimed in claim 10 wherein flow-rate of the liquid is 100 to 300 ml/minute.

14. A shower apparatus as claimed in claim 10 wherein temperature of the liquid is from 10° C. to 60° C.

15. A shower apparatus as claimed in claim 10 wherein said apparatus provides one shower in one to two minutes.

* * * * *